United States Patent [19]

Focke

[11] 4,159,609

[45] Jul. 3, 1979

[54] PROCESS AND DEVICE FOR INSERTION OF TWO ROWS OF OBJECTS INTO A PACKAGE

[76] Inventor: Heinz Focke, Moorestrasse, 309 Verden, Fed. Rep. of Germany

[21] Appl. No.: 833,209

[22] Filed: Sep. 14, 1977

Related U.S. Application Data

[60] Continuation-in-part of Ser. No. 633,136, Nov. 18, 1975, Pat. No. 4,057,950, which is a division of Ser. No. 390,263, Aug. 21, 1973, Pat. No. 3,937,391, which is a continuation-in-part of Ser. No. 83,581, Oct. 23, 1970, abandoned.

[30] Foreign Application Priority Data

Oct. 23, 1969 [DE] Fed. Rep. of Germany ..... 1953350

[51] Int. Cl.[2] ..... B65B 11/10

[52] U.S. Cl. ..... 53/452; 53/462

[58] Field of Search ..... 53/29, 32, 34, 48, 191, 53/192, 207, 208, 209, 218; 206/183, 184, 187; 29/28 R, 29 D

[56] References Cited

U.S. PATENT DOCUMENTS

| | | | |
|---|---|---|---|
| 2,605,598 | 8/1952 | Mackenzie | 53/207 |
| 2,712,882 | 7/1955 | Buttery et al. | 260/183 X |
| 2,718,301 | 9/1955 | Palmer | 53/48 |
| 2,885,842 | 5/1959 | Boitel | 53/34 |
| 3,083,510 | 4/1963 | Ganz | 53/48 |
| 3,166,879 | 1/1965 | Chidsey, Jr. et al. | 53/48 X |
| 3,182,431 | 5/1965 | Ganz | 53/32 |
| 3,196,588 | 7/1965 | Chidsey, Jr. | 53/32 |
| 3,430,413 | 3/1969 | Wood | 53/48 |

*Primary Examiner*—John Sipos

*Attorney, Agent, or Firm*—Sughrue, Rothwell, Mion, Zinn and Macpeak

[57] ABSTRACT

Process for insertion of two rows of objects, for example, bottles, cans and the like, into a package, which consists mainly of a blank of foldable material with a top wall, side walls adjacent on both sides and bottom halves connected to them, as well as the edge tabs folded upwards, which form a longitudinal stiffener, characterized by that the blank is placed on the rows of the objects which are in an inclined position and with their bottoms spread, wrapping the side walls and the bottom halves around each row of the objects, lifting the edge tabs, folding them between the rows of the objects and pressing and glueing the edge tabs together.

6 Claims, 15 Drawing Figures

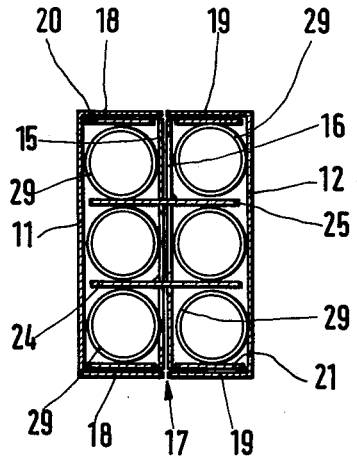
Fig. 2
Fig. 3
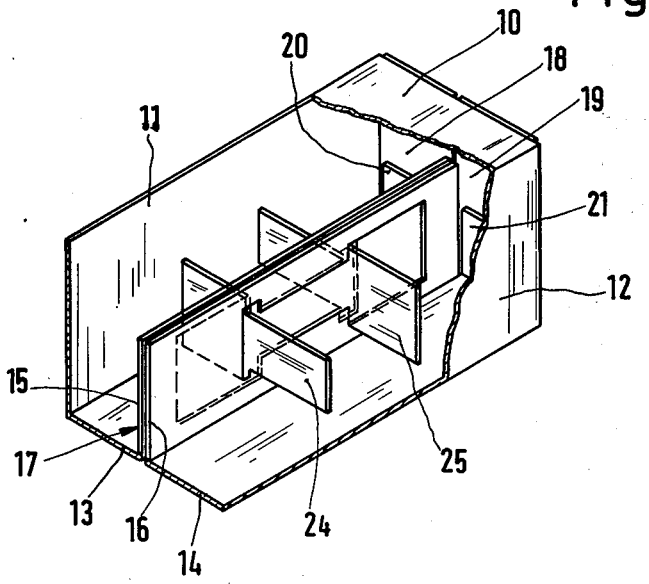

PROCESS AND DEVICE FOR INSERTION OF TWO ROWS OF OBJECTS INTO A PACKAGE

CROSS REFERENCE TO RELATED APPLICATION

This application is a CIP of applicant's copending application Ser. No. 633,136, filed Nov. 18, 1975, now U.S. Pat. No. 4,057,950 which is a Divisional application of Ser. No. 390,263, filed Aug. 21, 1973, now U.S. Pat. No. 3,937,391, granted Feb. 10, 1976, and which in turn is a CIP of Ser. No. 83,581, filed Oct. 23, 1970, now abandoned.

SUMMARY OF THE INVENTION

The invention deals with the process and a device for insertion of two rows of objects, for instance bottles, cans and the like, into a package which consists mainly of a blank of foldable material with a top wall, side walls adjacent on both sides and bottom halves connected to them as well as the edge tabs which by folding upwards, form a longitudinal stiffener.

The invention is related to a special type of packaging made of cardboard, corrugated cardboard or the like. The bottom halves receiving one row of the objects each, and the longitudinal stiffener located between the two rows form two halves of the package, each of them accommodating one row of objects. In addition to the double-walled longitudinal stiffener formed by the two edge tabs, one can provide cross-stiffeners, which enter between the objects arranged longitudinally within the package. These cross-stiffeners can form a part of the longitudinal stiffener as swivel tabs, or they can be fitted onto the longitudinal stiffener as downwards slit blanks.

The purpose of the invention is a process and a suitable device to enable mechanized manufacture, filling and closure of packages, as described above, of objects being conveyed on a continuous basis.

The subject process solves the task by placing the package blank from above onto the rows of objects supported from the bottom in an inclined position, wrapping the side walls and the bottom halves around each row of objects, folding the edge tabs in between the rows of the objects, whereupon the rows are straightened up and brought together when the edge tabs are pressed against each other and glued together.

The folding and filling procedure, described above, is continuous, which means that it occurs during uninterrupted conveying of the objects and packages. Each half of the package, i.e., bottom halves and edge tabs, divided in the lower part by the bottom halves and connecting edge tabs of the longitudinal stiffener, is folded around a spread row of packages diverging towards the bottom. Thereafter, these filling package halves are moved together until the edge tabs contact each other, forming in this manner a square-shaped package. The folding and filling procedure described above, i.e. the folding of the bottom halves and edge tabs around each of the rows of packages and simultaneous folding of the side walls from an almost horizontal to the final vertical position, is based on the spreading movement of the rows of objects. These rows of objects move during the transport from their originally vertical and slightly divergent position to an increasingly inclined position until at a certain point the spread rows of objects contact the corresponding side wall and rest on one of the bottom halves. From then on the package and the two rows of objects are conveyed as a whole.

The folding and filling procedure described above makes it possible to under size the package so that its inside dimensions are slightly smaller than the outside dimensions of the objects. For example, the side walls of a package intended for bottles are approximately 1% shorter in the vertical direction and the dimensions of the covering (top) wall are reduced by approximately 2%. Accordingly, the side walls tend to converge in an upward direction in the region of the bottle necks and the top wall is slightly arched.

However, due to the spread position of the objects and the downward divergence of the package halves, the objects can be inserted without the use of force. The undersizing of the package will show only when the two package halves come together in the lower part, when the prefolded package blank is wrapped around the objects under tension. The objects are locked in this manner in the package, no matter what its position.

The foregoing and other objects, features and advantages of the invention will be apparent from the following more particular description of a preferred embodiment of the invention as illustrated in the accompanying drawings.

BRIEF DESCRIPTION OF THE DRAWINGS

FIG. 2 is a horizontal sectional view through a package using the blank as per FIG. 1;

FIG. 3 is an isometric view of the package as per FIG. 2, with sides partly removed;

DETAILED DESCRIPTION OF THE INVENTION

Figure 1:
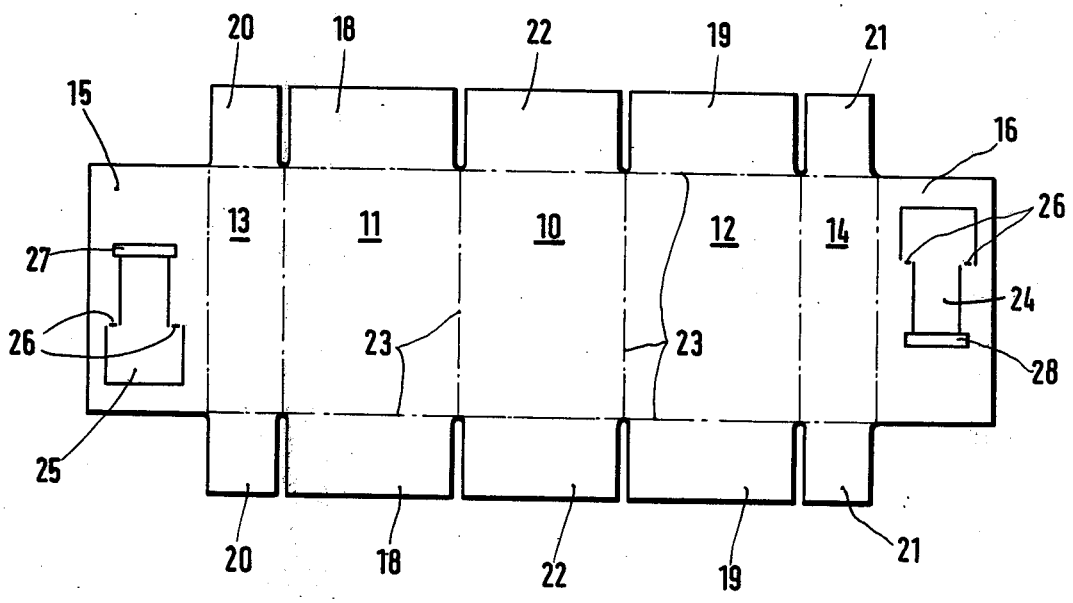
FIG. 1 is a plan view of an unfolded blank for a package according to the subject process.

The invention deals with packages, characterized by a certain basic form. The upper closed top wall (10) carries on its opposite edges side walls (11 and 12). The package bottom is divided longitudinally, consisting of the bottom halves (13 and 14) secured to the edges of the side walls. These carry at their edges the package edge tabs (15 and 16), which are connected together in a finished package, for example by glueing, forming in this manner a central double-walled longitudinal stiffener (17). In the packaging of bottles this stiffener is generally the height of the lower main part of the bottles or slightly higher. In this case the front walls of the package are closed by means of the end tabs (18 and 19) attached to the side walls as well as the corner tabs (20 and 21) attached to the bottom halves (13 and 14). The end tabs (18 and 19) as well as the corner tabs (20 and 21) overlap diagonally and are joined, for instance, by glueing. The end tabs (18 and 19), in turn, are overlaped on the outside by closing tabs (22) attached to the top wall (10).

FIG. 1 shows a blank for a package of the above described design. The boundaries of the blank which form individual walls etc., are defined by prepunched bend lines (23), shown in this case as chain-dotted.

The illustrated example of the packages is provided, in addition to the longitudinal stiffener (17), with cross-stiffeners. In this case, these are made as straps (24 and 25) prepunched in the edge tabs (15 and 16). The straps (24 and 25) are connected with the rest of the edge tabs (15 and 16) by bridges (26). Each of the straps (24 and 25), in turn, is flipped around one of the bend lines in the bridge area into a position perpendicular to the edge tabs (15 and 16) to form a cross-stiffener. For this reason, one half each of the straps (24 and 25) is located on each side of the edge tabs (15 and 16) and the longitudinal stiffener (17) formed in this manner. Each of the halves of the straps (24 and 25) projecting in the adjacent half of the package is inserted into the slot (27 and 28) of the adjacent edge tabs (15 and 16). This makes it possible to form compartments by means of the two straps (24 and 25) to accommodate six objects, i.e. two rows with three objects each.

Figure 4:
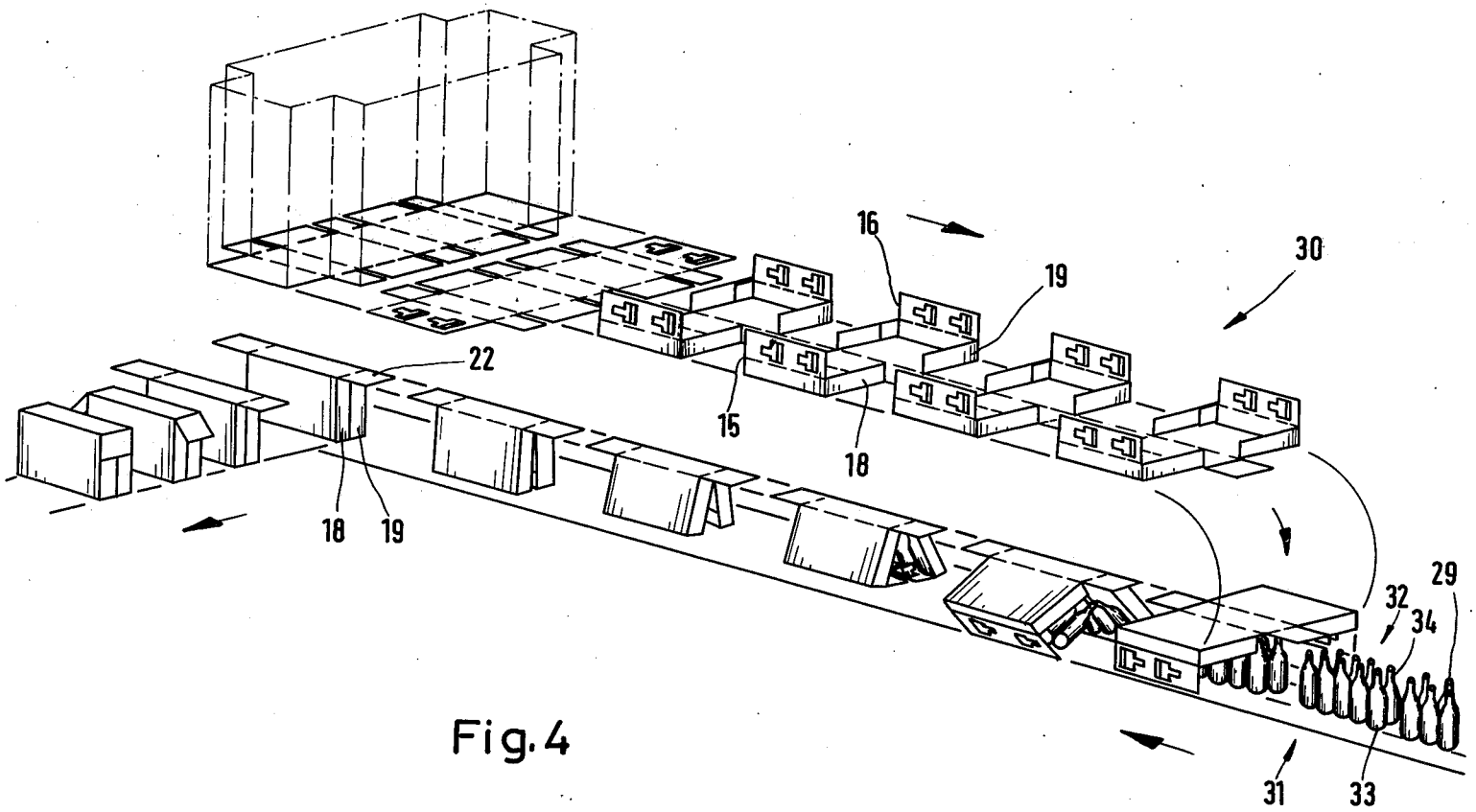
FIG. 4 is an isometric diagrammatic view of the folding and filling procedure based on the subject process.

A package prepared in the above-mentioned manner is folded and filled with objects, for example bottles (29) as shown in FIG. 4. The blank shown in FIG. 4 differs from the one in FIG. 1 in that each of the end tabs (15 and 16) is provided with two straps instead of one strap.

The flat blank is first partly folded. For this purpose, the bottom halves (13 and 14) with connecting edge tabs (15 and 16) are brought in an upright position with respect to the horizontal side walls (11 and 12) with the top wall 10 in between. The end tabs (18 and 19) and the corner tabs (20 and 21) are straightened up in a similar manner. The latter are brought to the inside of the straightened end tabs (18 and 19) and joined with them, for example, by glueing. In this manner an intermediate shape of the package is formed moving on the upper conveyor (30) as shown in FIG. 4.

The objects, i.e. bottles (29), are conveyed under the upper conveyor (30) on a lower conveyor (31) in two adjacent rows. From these endless rows, groups (32) are formed in two rows, each consisting of row 33 and 34. The prefolded packages conveyed on conveyor (31) are turned 180° and placed on top of the bottles (29) with the bottom halves (13, 14) and end tabs (15, 16) aiming downwards, so that the top wall (10) is located in the area of the bottle caps.

From now on the groups 32 and the appropriate package travel together. During this movement the rows (33, 34) are being spread gradually so that they diverge towards the bottom of the bottles. At the same time, the side walls (11 and 12) are folded in opposite directions, from the horizontal position into an inclined and finally vertical position. At some point along the conveyor (31), the rows (33 and 34) have been moved by a mutual motion into their respective package halves, touching the side walls (11 and 12) and resting on the bottom halves (13, 14). In this manner, the rows (33, 34) so far in a spread position, are introduced into the unfinished package.

During further movement, the package halves and also the rows of bottles are being moved together at the bottom. Prior to this, the edge tabs (15 and 16) are folded upwards between the spread rows (33 and 34) and are moved closer together during the approach of the package halves. Finally, the closing tabs (22) protruding in the area of the top wall (10) are folded against the front walls of the package, i.e. against the end tabs (18 and 19).

The device for this folding and filling procedure is constructed in a conventional manner. FIGS. 5–13 show important details of the conveyor (31).

The approaching bottles (29) are conveyed in two rows (33 and 34) on support rails (35 and 36). The support rails (35 and 36) are shown in this case to be made of right angle members. The bottles (29) rest on the lower legs (37) and lean against the inward turned inside legs (38) arranged with a certain spacing. Between the two angle members moves a bottle conveyor, in this case an endless chain conveyor (39) with attachments (40) for each of the groups (32).

During further transport of the rows (33 and 34) with the partly folded packages on top, the bottles and packages are held in the required relative positions by guides of various length and shape. These are mainly guide rods arranged in the direction of the transport.

Figure 5:
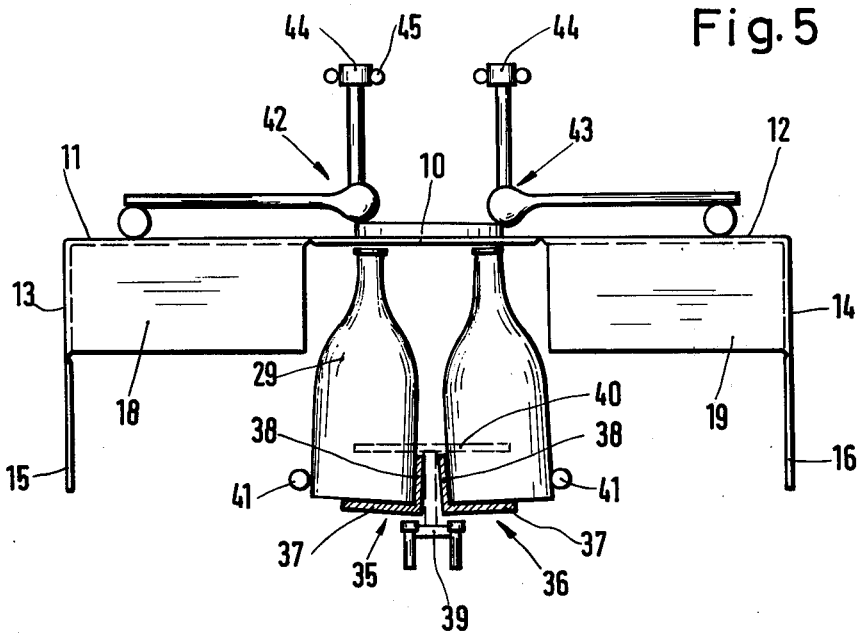
FIG. 5 to FIG. 12 are a series of sequential views of different phases of the package folding and filling procedure, showing the details of a device designed for the process, in cross-section perpendicular to the direction of the movement of the objects and the packages.

FIG. 5 shows a cross-section of conveyor (31) in its initial area. The rows (33 and 34) are held on the support rails (35 and 36) already slightly diverging at the bottom by guide rods (41) arranged on the outside. In the upper area of the side walls (11 and 12) are located the ends of the folding mechanism, i.e. two-armed folding levers (42 and 43). These and the corresponding package are further rotated by the folding levers (42 and 43) travelling over a certain distance of the track by applying the support rollers (44) to a curved rod (45). Due to the swivelling movement of the folding levers (42 and 43) shown in FIGS. 5, 6 and 7, the side walls (11 and 12) and the connected blank parts are folded downwards towards the bottles (29). The folding levers (42 and 43) are carried over a certain distance of the track by a conveying device not shown in detail.

Figure 6:
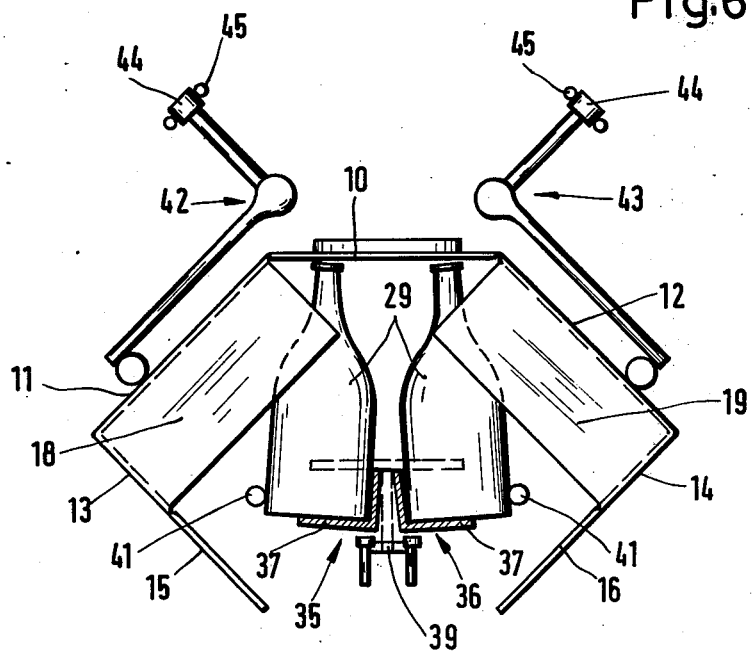

Cross-section in FIG. 6 shows the side walls (11 and 12) are already folded in this way into an inclined position. The bottles (29) are still in a position as shown in FIG. 5.

Figure 7:
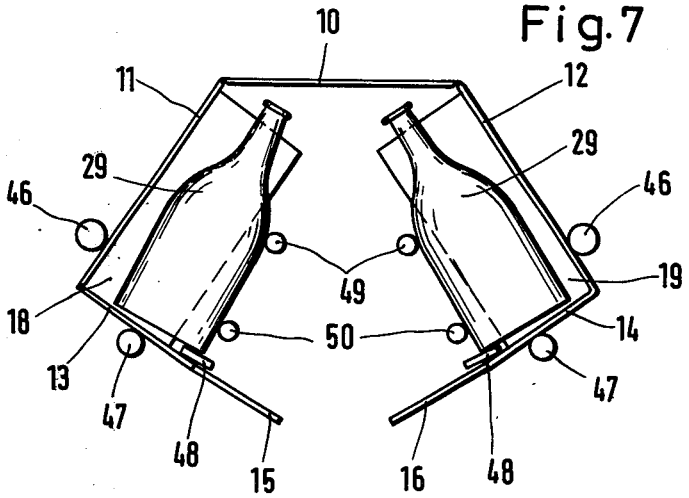

In the cross-section shown in FIG. 7 the folding levers (42 and 43) have been moved out of the package area. At the same time, outside rods (46) are placed to the side walls (11 and 12). These outside rods (46) converge in the direction of transport. In addition, there are lower rods (47) provided at the underside of the package in the area of the bottom halves (13 and 14), which support the package from below since with increasing spreading of the rows (33 and 34) the top wall (10) no longer rests immediately on the bottle caps. The support rails (35 and 36) originally made of angles, have gradually changed into relatively narrow flat strips (48). These support the bottom edges of the bottles (29) which are moved to the outside in a spreading movement. To bring about the vigorous spreading movement, two spreader rods (49 and 50) are provided between the rows (33 and 34) one on top of each other. At the start of the spreader track the aforementioned spreader rods (49 and 50) are connected with each other by their tips (see FIG. 13). The spreader rods (49 and 50) gradually diverge in the direction of transport, thereby effecting the gradual spreading of the adjacent bottles (29). In this area also the support rails (35 and 26), with the bottles inclined, are moved apart and at the same time change their shape from an angle into a flat (48).

Figure 8:
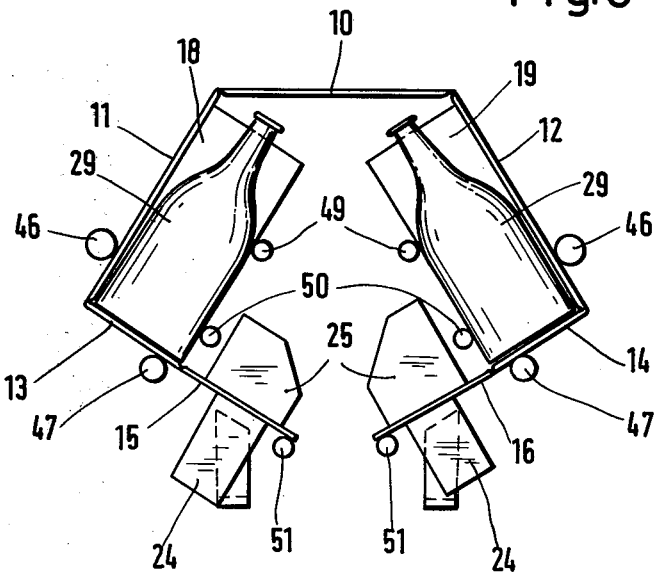

The final position of the spreading movement is shown in FIG. 8. The bottles are moved into the package halves until they touch the side walls (11 and 12) and the bottom halves (13 and 14).

Figure 9:
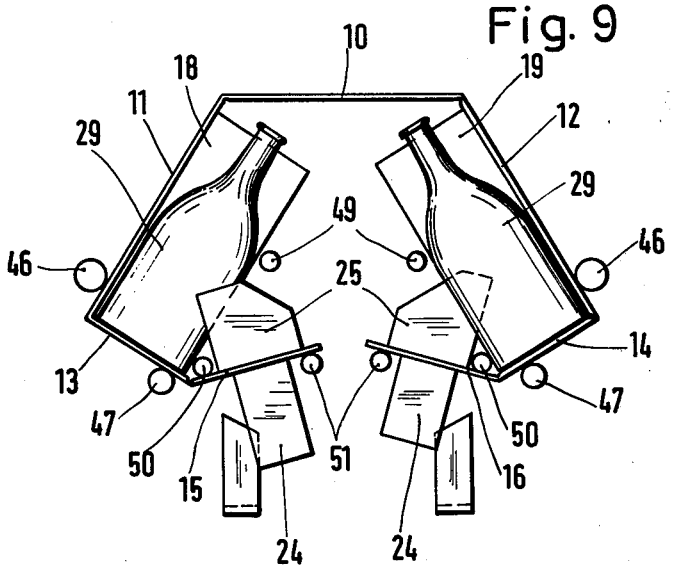
Figure 10:
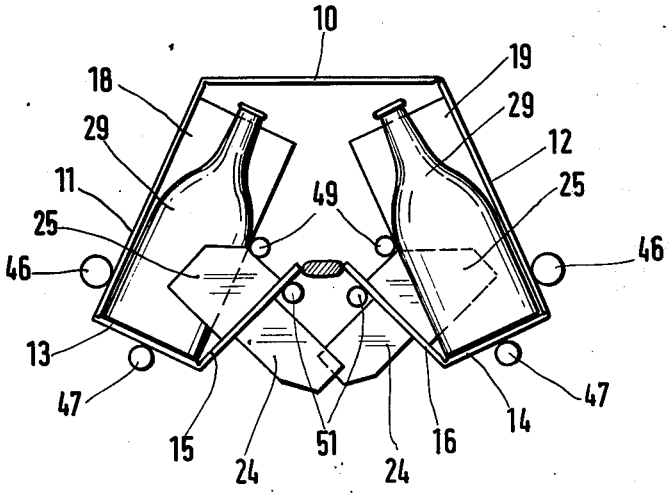
Figure 11:
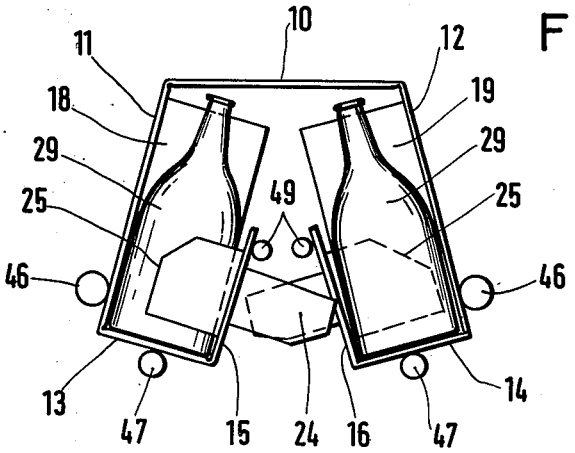
Figure 12:
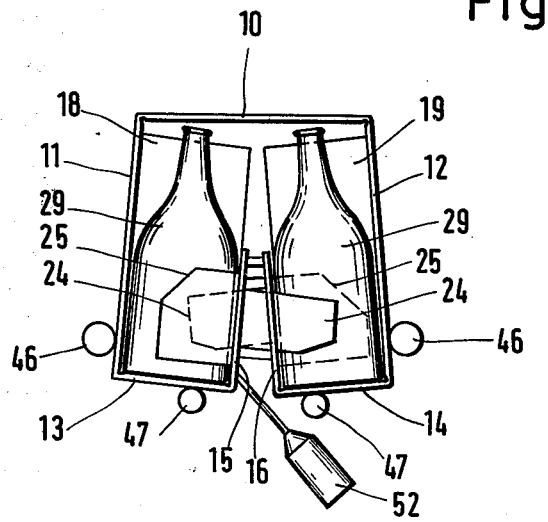
Figure 13A:
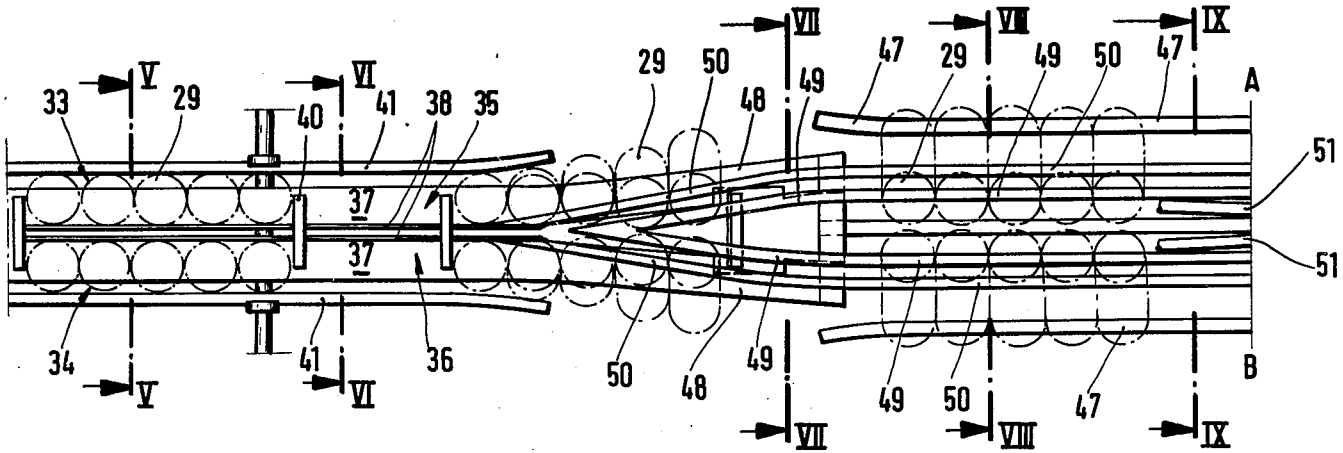
FIG. 13*a* and *b* is a plan view of subject device showing its main details.
Figure 13B:
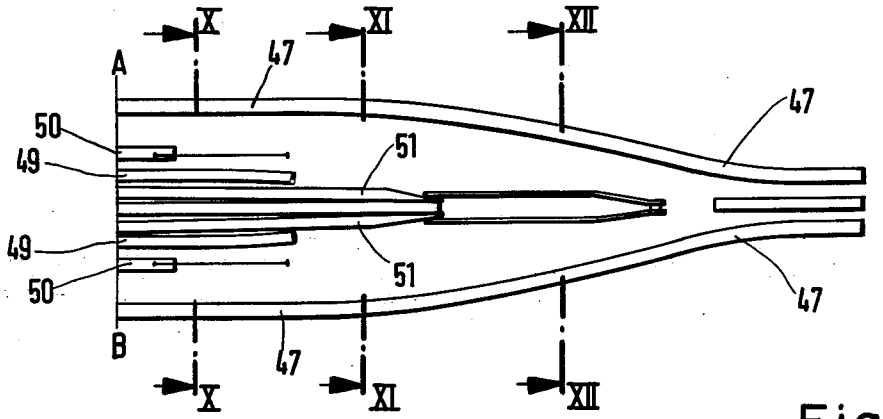

In this area new guide rods are added, i.e one supporting rod (51) under each of the edge tabs (15 and 16). During further movement this support rod causes the inward swivelling of the edge tabs (15 and 16) in between the spread bottles (29) (FIGS. 9 and 10). During this continuous folding procedure the lower spreader rod (50) from time to time travels towards the bottom area of the bottles (29) to secure a perfect folding of the edge tabs (15 and 16) over the bottom halves (13 and 14). Toward the end of the conveyor (31) all of the rods between the rows (33 and 34) terminate. The package halves are now moved together by outside support devices, for instance by the outside rods (46), and eventually also by an additional compressing device until they contact the opened edge tabs (15 and 16). Prior to this, a glue nozzle (52) may be attached onto the conveyor (31), applying glue to the areas of the edge tabs (15 and 16) to be joined together.

As soon as the package has the cross-stiffeners formed by the straps (24 and 25), these straps (24 and 25) are folded perpendicular to the edge tabs (15 and 16), preferably in the maximum spread position (see FIG. 8), by a suitable device not shown in detail. For this purpose support rods (51) are provided on the outside of the straps (24 and 25).

During further folding movement, i.e the folding of the edge tabs (15 and 16) and the following approach of the package halves in its lower part, the halves of the straps (24 and 25) are inserted between the bottles (29) which are separated in this manner, which is done partly by passing through the corresponding slots (27 and 28).

Figure 14:
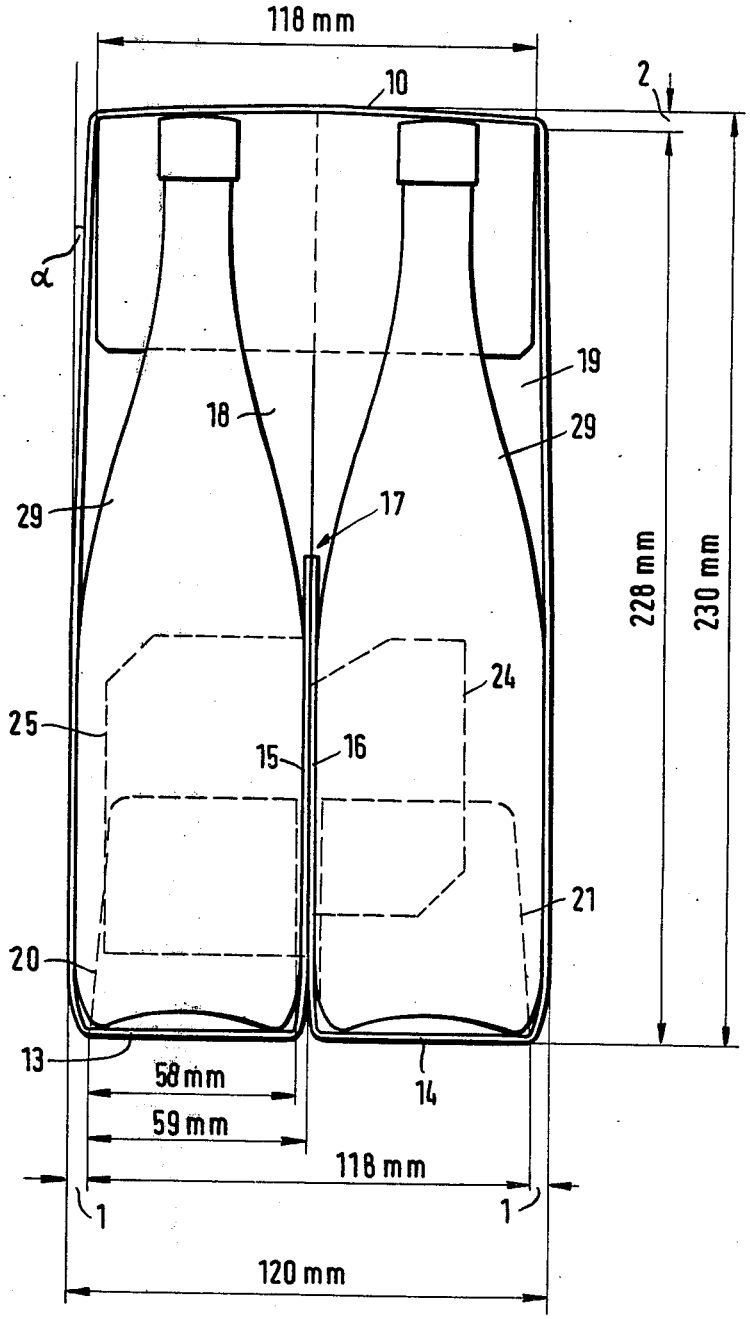
FIG. 14 is a sectional view of a completed filled package formed from a blank which is under dimensioned relative to the dimensions of the objects in the package.

Since the top wall 10, the side walls 11 and 12 and the bottom walls 13 and 14 can be under-dimensioned relative to the dimensions of the bottles as shown in FIG. 14 the package will be wrapped about the bottles under tension to securely hold the bottles in place within the containers. The top wall 10 will be bowed and the side walls 11 and 12 adjacent the upper half of the bottles will be disposed at an angle $\alpha$ relative to the vertical.

While the invention has been particularly shown and described relative to a preferred embodiment thereof, it will be understood by those in the art that various changes in form and details may be made therein without departing from the spirit and scope of the invention.

What is claimed is:

1. A process for inserting two rows of articles such as bottles, cans or the like into a container which is formed from a one-piece planar blank of foldable material having a one-piece undivided rectilinear top wall, side walls integral with said top wall on both sides thereof, bottom walls integral with the side walls and edge flaps integral with the bottom walls comprising folding the bottom walls and edge flaps simultaneously relative to said top wall and side walls so as to dispose said bottom walls and edge flaps at right angles to said top wall and side walls, initially spreading the two rows of articles relative to each other, placing the folded blank on the two rows of articles with the top wall of the blank in engagement with the tops of the articles, simultaneously further spreading the bottoms of the two rows of articles apart and folding the side walls of the container relative to the top wall of the container until said side walls contact the sides of the articles and the previously folded bottom walls of the container contact the bottoms of the articles, bending the edge flaps upwardly between the two rows into engagement with the opposed sides of the two rows of articles, pressing the edge flaps together by bringing the two rows of articles together and adhesively securing the flaps together.

2. A process as set forth in claim 1, wherein said blank of foldable material is provided with end tabs connected to the opposite ends of each side wall and corner tabs connected to the opposite ends of both bottom walls and further comprising folding the end tabs and corner tabs at right angles to said side walls and bottom walls respectively and adhesively securing said end tabs and corner tabs together upon said folding of said bottom walls relative to said side walls.

3. A process as set forth in claim 1, wherein the edge flaps of said blank are provided with cross strips which are pre-stamped therein and further comprising folding said cross strips into a position perpendicular to said edge flaps to form cross pieces prior to bending the edge flaps upwardly so that upon bending the edge flaps upwardly between the two rows of articles, the cross pieces will be disposed between the individual articles in each row.

4. A process as set forth in claim 2, wherein the edge flaps of said blank are provided with cross strips which are pre-stamped therein and further comprising folding said cross strips into a position perpendicular to said edge flaps to form cross pieces prior to bending the edge flaps upwardly so that upon bending the edge flaps upwardly between the two rows of articles, the cross pieces will be disposed between the individual articles in each row.

5. A process according to claim 1, wherein the inner dimensions of the container are slightly smaller than the outside dimensions of the articles and further comprising tensioning the container about the articles by bringing the two rows of articles together.

6. A process as set forth in claim 2, wherein the inner dimensions of the container are slightly smaller than the outside dimensions of the articles and further comprising tensioning the container about the articles by bringing the two rows of articles together.

* * * * *